United States Patent [19]

Niino et al.

[11] Patent Number: 4,583,384

[45] Date of Patent: Apr. 22, 1986

[54] CONTROL DEVICE FOR CONTINUOUS ROLLING MACHINE

[75] Inventors: Shuhei Niino; Koichi Ishimura; Ken Okamoto; Koichi Ohba, all of Hyogo, Japan

[73] Assignee: Mitsubishi Denki Kabushiki Kaisha, Tokyo, Japan

[21] Appl. No.: 428,497

[22] Filed: Sep. 29, 1982

[30] Foreign Application Priority Data

Sep. 30, 1981 [JP] Japan ..... 56-157209
Sep. 30, 1981 [JP] Japan ..... 56-157210

[51] Int. Cl.[4] ..... B21B 37/02
[52] U.S. Cl. ..... 72/8; 72/12; 72/16; 72/235; 364/472
[58] Field of Search ..... 72/16, 12, 235, 8, 9, 72/11; 364/472

[56] References Cited

U.S. PATENT DOCUMENTS 3,526,113 9/1970 McNaugher ..... 72/8
4,386,511 6/1983 Morita ..... 72/16

FOREIGN PATENT DOCUMENTS 0024261 8/1975 Japan ..... 72/16
0039067 12/1975 Japan ..... 72/12
1513962 6/1978 United Kingdom ..... 72/16

*Primary Examiner*—Francis S. Husar
*Assistant Examiner*—Steven B. Katz
*Attorney, Agent, or Firm*—Sughrue, Mion, Zinn, Macpeak, and Seas

[57] ABSTRACT

A control device for a continuous rolling machine adjusts the rolling position of an ith mill stand to correct a first rolling material dimension and simultaneously controls the rolling position of an (i−1)th mill stand to adjust a perpendicular dimension of the rolling material to compensate for changes caused by the adjustment of the rolling position of the ith mill stand.

5 Claims, 5 Drawing Figures

CONTROL DEVICE FOR CONTINUOUS ROLLING MACHINE

BACKGROUND OF THE INVENTION

This invention concerns dimension control of a rolling material in a continuous rolling machine having a hole roll, for example, a bar steel mill and a wire mill.

An example of the structure of a continuous rolling machine having a hole roll is shown in FIG. 1. FIG. 1 shows a continuous rolling machine comprising i mill stands, including a first mill stand 1, a second mill stand 2, an (i−1)th mill stand 3 and an ith mill stand 4, and a rolling material 5 successively rolled through these mill stands.

In the continuous rolling machine of this kind, i.e. a vertical-horizontal (VH) mill, horizontal mills (odd-numbered mills in FIG. 1) and vertical mills (even-numbered mills in FIG. 1) are usually arranged alternately. For instance, the (i−1)th mill stand 3 is a vertical mill performing the rolling in the direction X in which bi−1 represents the lateral dimension and hi−1 represents the vertical dimension at the exit of the (i−1)th mill stand 3. While on the other hand, the ith mill stand 4 is a horizontal mill performing the rolling in the direction Y in which bi represents the lateral dimension and hi represents the vertical dimension at the exit of the ith mill stand 4.

Conventional continuous rolling machines such as a bar steel mill and a wire mill include, for example, those adapted to control the speed of a motor that drives the (i−1)th mill stand 3 so that the amount of the loop between the ith mill stand 4 and the (i−1)th mill stand 3 may be rendered constant, or those adapted to control the rolling position by detecting the change of the vertical dimension at the exit of the mill by mill rigidity control devices (BISRA control devices) based on the rolling load detected by load cells. As used herein and in the appended claims, "rolling position" refers to the distance between opposed rollers in a particular mill stand. However, machines employing dynamic control have so far been unknown for a number of reasons, for instance since there have been no severe requirements for the dimensions of products, and since mill elongation due to the change in the load during rolling is small (which makes the dimensional accuracy of the products better since the effect of transferring the change at the inlet of the rolling material to the exit is decreased).

Accordingly, since no dynamic control has been provided in the conventional control system for compensating the change in the dimension of the rolling material relative to changes in the temperature or the like, the dimensional accuracy is sometimes unsatisfactory.

SUMMARY OF THE INVENTION

This invention has been made in view of the foregoing drawback, and it is an object of this invention to roll a rolling material into a highly accurate dimension by detecting the vertical dimension of the material at the exit of a mill and by dynamically controlling the rolling position of the mill so that a difference between a detected value and a reference dimension becomes zero. The change in the lateral dimension which results from the first correction is compensated by controlling a rolling position of the mill at the preceeding stage.

In a second embodiment, the vertical and lateral dimensions of a material are both detected at the exit of an ith mill stand 4 and the rolling positions of the ith mill stand and the (i−1)th mill stand are respectively controlled so that differences between the detected values and reference vertical and lateral dimensions are reduced to substantially zero while at the same time the change in the lateral dimension of the material at the exit of the ith mill stand due to the adjustment of the ith mill is compensated by adjusting the rolling position of the (i−1)th mill stand.

BRIEF DESCRIPTION OF THE DRAWINGS

The invention will be more clearly understood from the following description in conjunction with the accompanying drawings wherein the same or corresponding components are designated by like reference numerals, and wherein.

DETAILED DESCRIPTION OF THE INVENTION

Figure 2:
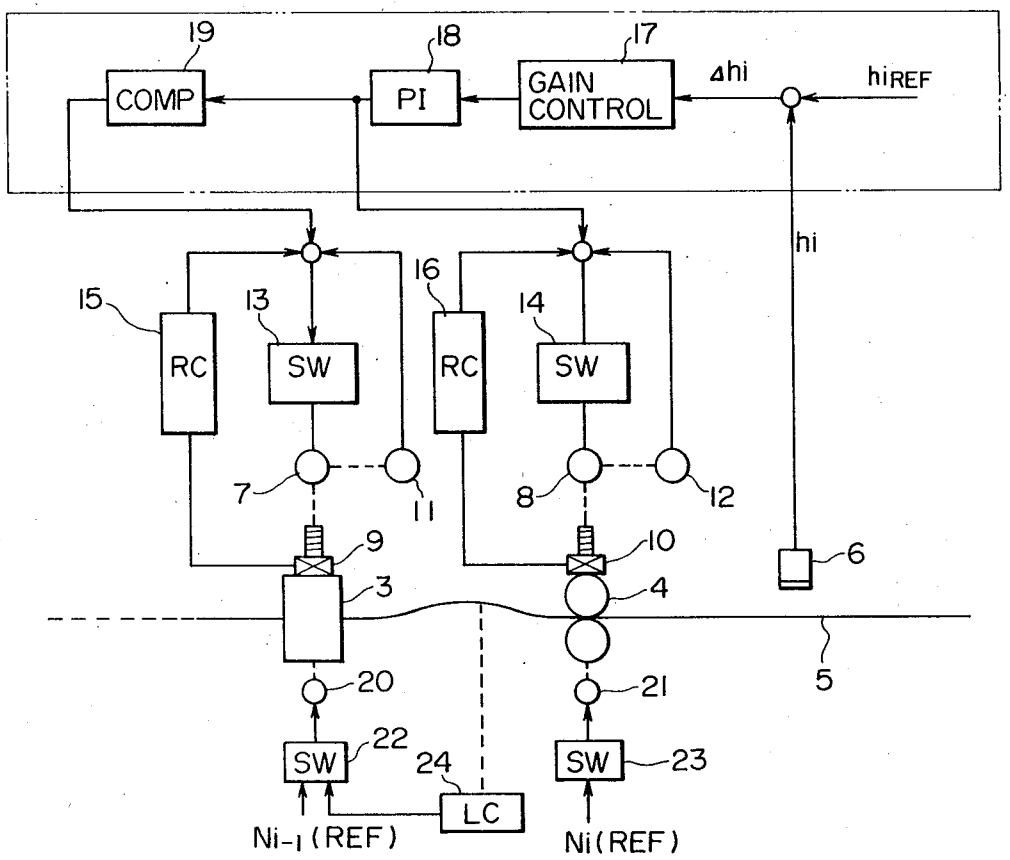
FIG. 2 is a block diagram showing a dimension control device in a continuous rolling machine according to a first embodiment of this invention.

FIG. 2 shows a control device according to this invention. In FIG. 2, are shown an (i−1)th mill stand 3, an ith stand (final stand) 4, a rolling material 5, a dimension detection device 6 for detecting the vertical dimension of the rolling material at the exit of the ith mill stand 4, rolling drive motors 7, 8 for respective stands, load cells 9, 10 mounted to the respective stands for the detection of the rolling load, pulse generators 11, 12 connected to the rolling drive motors 7, 8, respectively, for detecting the rolling position, motor driving thyristor switches 13, 14 for feeding electric power to the rolling drive motors 7, 8, mill rigidity control (RC) devices 15, 16 for respective stands, a gain control device that applies a predetermined gain to a difference signal Δhi between a detection value hi from the dimension detection device 6 and a reference dimension hREF, a proportion and integration (PI) control device 18 that applies a PI control to the output signal from the gain control device and outputs a rolling position correction signal to the ith mill stand 4, a compensation device 19 that receives the output from the proportion and integration control device and outputs a rolling position correction signal to the (i−1)th mill stand 3, a drive motor 20 for the rollers in the (i−1)th mill stand 3, a drive motor 21 for the rollers in the ith mill stand 4, driving thyristor switches 22, 23 for respective motors 20, 21, and a loop control device 24 that constantly controls the amount of a loop between the (i−1)th mill stand 3 and the ith mill stand 4.

In most of the prior systems, the loop control device 24 applies speed correction to the motor 20 for the (i−1)th mill stand 3 so that the amount of the loop between the (i−1)th mill stand 3 and the ith mill stand 4 is made constant relative to the motor 20 for the (i−1)th mill stand rotating at a speed Ni−1 (REF) set by the thyristor 22. However, in such a system, the dimension of the products is determined only by the characteristic of the mill and, therefore, no dynamic dimension control is possible. Further, there has been mill rigidity control (BISRA control) in the prior art in which the rolling position is controlled by detecting the change in the lateral dimension by the mill rigidity control device and the vertical dimension by the mill rigidity control device 15, 16 due to the rolling load detected by the load cells 9, 10, respectively, but since it is impossible to control both of the lateral and vertical dimensions together, the overall accuracy of the final dimension was poor.

In the control according to this invention, the rolling position of the ith mill stand 4 is controlled so that the detected change in the vertical dimension of the rolling material becomes zero at the exit of the ith mill stand while, at the same time, the change in the lateral dimension which results from adjusting the position of the ith mill stand is automatically compensated by controlling the rolling position at the (i−1)th mill stand 3.

Figure 1:
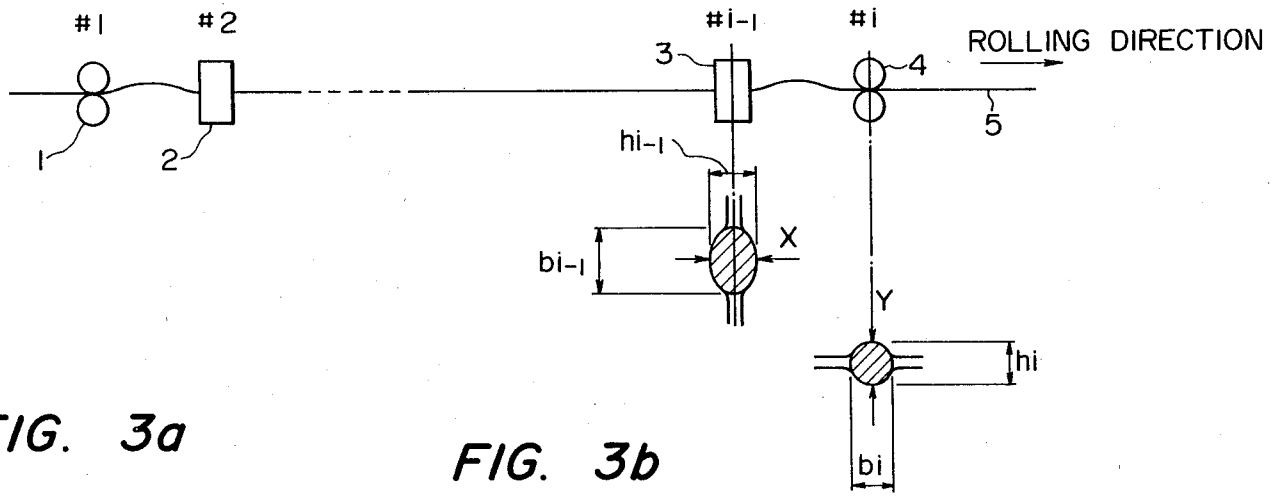
FIG. 1 is a schematic illustration of an example of a conventional structure of a continuous rolling machine having a hole roll.
Figure 3A:
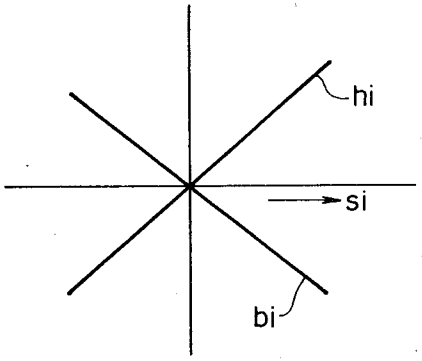
FIGS. 3(*a*) and 3(*b*) are characteristic diagrams illustrating the relationship between the rolling positions of mills and the vertical and lateral dimensions of a rolling material.
Figure 3B:
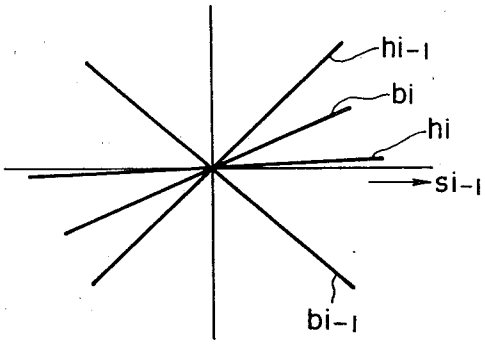

This will be more clearly explained with reference to FIG. 3. FIG. 3*a* represents the change in the vertical dimension hi and the change in the lateral dimension bi at the exit of the ith mill stand 4 in the case where the rolling position Si of the ith mill stand is changed. FIG. 3*b* represents the change in the vertical dimension hi−1 and the change in the lateral dimension bi−1 at the exit of the (i−1)th mill stand 3, as well as the change in the lateral dimension bi and the change in the vertical dimension hi at the exit of the ith mill stand 4 in the case where the rolling position Si−1 of the (i−1)th mill stand 3 is changed.

As can be seen from FIG. 3*b*, the change in the rolling position Si−1 of the (i−1)th mill stand 3 causes no substantial change in the vertical dimension hi at the exit of the ith mill stand 4 and it is substantially impossible to change the vertical dimension hi unless the rolling position Si of the ith mill stand 4 is controlled as shown in FIG. 3*a*. However, changing the rolling position Si of the ith mill stand 4 also causes the lateral dimension bi to be changed. Taking notice of the fact that the lateral dimension bi at the exit of the ith mill stand 4 is changed by the change in the rolling position of the (i−1)th mill stand 3, the change Δbi in the lateral dimension which results from movement of the ith rolling position is compensated by controlling the rolling position of the (i−1)th mill stand 3.

The control device according to this invention will now be described more in detail. The vertical dimension hi of the rolling material 5 is detected by the dimension detection device 6 disposed at the exit of the ith mill stand 4. Then, a vertical dimension difference Δhi between the detected vertical dimension hi and a reference value hiREF for the vertical dimension is introduced to the gain control device 17.

The gain control device 17 applies a predetermined gain to the introduced difference signal Δhi and provides the result to the proportion and integration control device 18. The gain Kh of the gain control device 17 is preferably represented as:

$$Kh = 1/(\delta hi/\delta Si)$$

where Si represents a rolling correction amount for the ith mill stand 4 and Kh represents the relationship between an incremental change in the rolling position of the ith mill stand 4 and the corresponding change in the vertical dimension of the rolling material at the exit of the mill.

The proportion and integration control device 18 applies this PI control to the output from the control gain device 17 and provides the processed result, as a rolling position correction signal to the ith mill stand 4, to the rolling position control device comprising the thyristor 14, the motor 8, and the pulse generator 12. Specifically, the motor 8 is driven by the rolling position correction signal via the motor driving thyristor 14 until the rolling position signal detected by the pulse generator 12 coincides with the rolling position correction signal to thereby correct the rolling position.

Now, control for the rolling position of the ith mill stand 4 naturally causes a change in the lateral dimension bi at the exit of the ith mill stand 4. In other words, since the lateral dimension accuracy is degraded when correcting the vertical dimension hi, it is necessary to compensate for the change in the lateral dimension at the ith mill stand 4 by controlling the rolling position of the (i−1)th mill stand 3.

Assuming that the change in the lateral dimension due to the adjustment of the rolling position of the ith mill stand 4 is given by Δbi and the change in the lateral dimension at the exit of the ith mill stand 4 due to the adjustment of the rolling position of the (i−1)th mill stand 3 is given by Δbi', the change Δbi in the lateral dimension at the ith mill stand 4 can be compensated by controlling the rolling position of the (i−1)th mill stand 3 so that the value Δbi+Δbi' becomes substantially zero. Specifically, the output from the proportion and integration control device 18 is provided as an input to the compensation device 19, which derives an appropriate second rolling position correction signal for controlling the rolling position of the (i−1)th mill stand 3.

Assuming that the coefficient of the change in the rolling position of the ith mill stand 4 to the change in the lateral dimension at the ith mill stand 4 is given by Kbi and that the coefficient of the change in the rolling position of the (i−1)th mill stand 3 to the change in the lateral dimension at the exit of the ith mill stand 4 is given by Kbi−1, the gain in the compensation device 19 can be expressed as Kbi−1/Kbi, where Kbi is 1/(δbi/δSi) and Kbi−1 is 1/(δbi/δSi−1).

The second rolling position correction signal issued from the compensation device 19 is supplied to the rolling position control device comprising the thyristor 13, the motor 7 and the pulse generator 11, which corrects the rolling position of the (i−1)th mill stand 3 to thereby compensate the change in the lateral dimension of the rolling material 5 at the exit of the ith mill stand 4.

Although the proportion and integration control device 18 is explained as performing proportion+integration (PI) control in the foregoing explanation, integration control or proportion+integration+differentiation (PID) control is also possible. In addition, while the above explanation has been given for the case where the dimension detector 6 is disposed at the exit of the final mill stand, it can of course be mounted between the stands while still achieving the desired dimension control.

Figure 4:
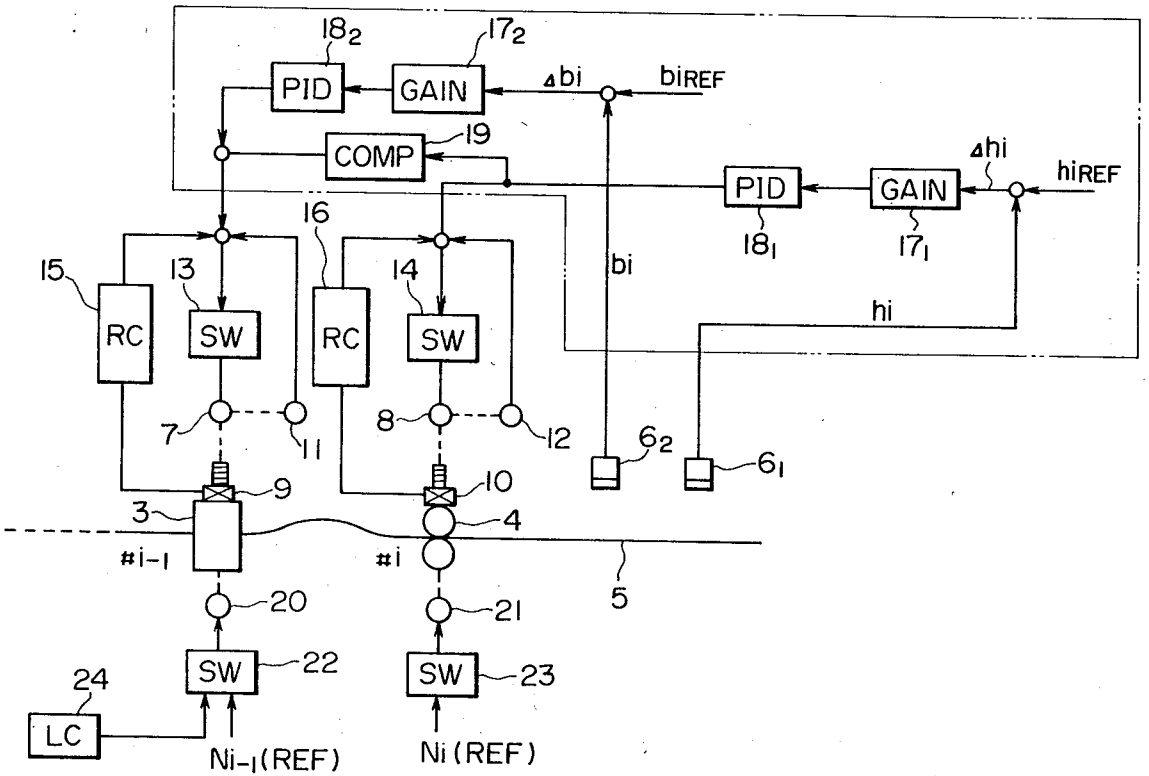
FIG. 4 is a block diagram showing a dimension control in a continuous rolling machine according to a second embodiment of this invention.

A second embodiment of a continuous rolling machine according to this invention will now be described with reference to FIG. 4. The arrangement of FIG. 4 is substantially similar to that of FIG. 2 except for the structure used to generate the rolling position correction signals. More specifically, whereas the embodiment of FIG. 2 included a single dimension detector 6 for detecting the vertical dimension of the rolling material at the output of the mill, the embodiment of FIG. 4 includes a first dimension detector $6_1$ for detecting the vertical dimension of the rolling material and a second dimension detector $6_2$ for detecting the lateral dimension of the rolling material. The detected vertical dimension hi is compared with a reference vertical dimension hiREF to generate a vertical dimension error Δhi which is provided with an appropriate gain in a gain control device $17_1$ in the same manner as in the embodiment of FIG. 2. The gain controlled signal is then provided to a control device $18_1$ which generates a PID control signal in a well-known manner. This control signal is then provided through thyristor 14 to the motor 8 and through the compensation circuit and thyristor 3 to the motor 7 in the same manner as in the embodiment of FIG. 2.

An additional feature of the embodiment of FIG. 4 resides in that the lateral dimension detection signal bi is compared with a lateral dimension reference signal biREF to obtain a lateral dimension error signal Δbi which is provided through a gain control circuit and control device $17_2$ and $18_2$, respectively, in a manner similar to the processing of the vertical dimension error signal in both the first and second embodiments. The rolling position of the (i−1)th mill stand 3 is then controlled in accordance not only with the output of the compensation circuit 19 but also in accordance with the output of the control device $18_2$.

In the embodiment of FIG. 4, the gain of the gain control device $17_1$ may be the same value of Kh defined above, with the gain of the compensation device 19 being given by Kbi−1/Kbi as is the case with the embodiment of FIG. 2. The gain control device $18_2$ should have a control gain substantially equal to the above-defined Kbi−1.

An advantage of the fourth embodiment is that, due to the use of the additional lateral dimension detection device $6_2$, the lateral dimension of the rolling material can be corrected by adjusting the rolling position of the (i−1)th mill stand without the necessity of making any adjustment to the rolling position of the ith mill stand. Further, when an adjustment of the ith mill stand is made and a corresponding compensation adjustment to the (i−1)th mill stand is also made, the lateral dimension detection device $6_2$ will provide a degree of feedback for more accurate final control of the lateral dimension. As in the first embodiment of FIG. 2, the vertical dimension detection device $6_1$ and lateral dimension detection device $6_2$ may be disposed between mill stands rather than at the output of the final mill stand and the vertical and lateral dimensions of the rolling material may thus be controlled at the exit of a mill stand other than the final mill stand.

As has been described above, according to this invention, since a vertical dimension at the exit of a mill is detected and a rolling position for the mill is controlled so that the detected value may agree with the reference dimension while at the same time compensating for lateral dimension changes by controlling the rolling position of the mill at the preceeding stage, it provides an advantageous effect capable of performing the rolling with a high dimensional accuracy. Further, additional dimensioning accuracy can be obtained by detecting both the vertical and lateral dimensions of the rolling material and by combining the compensation signal from the compensation device 19 with an independently derived lateral dimension control signal in order to control the rolling position of the (i−1)th mill stand.

What is claimed is:

1. In a continuous rolling machine of the type wherein a rolling material is passed through a plurality of mill stands, each of said mill stands having a rolling position and an exit, a control device comprising: first rolling position control means controlling the rolling position of a first of said plurality of mill stands in accordance with a first rolling position control signal;

second rolling position control means controlling the rolling position of a second of said plurality of mill stands in accordance with a second rolling position control signal;

first detection means detecting a first dimension of said rolling material at the exit of one of said first and second mill stands and generating a first detection signal;

control signal means generating both of said first and second rolling position control signals in accordance with said first detection signal;

wherein the rolling position of the other of said first and second mill stands is variable in a direction corresponding to a second dimension substantially perpendicular to said first dimension; and wherein said control signal means further comprises first means comparing said first detection signal to a first reference signal to obtain a first difference signal;

second means responsive to said first difference signal and generating said first rolling position control signal in accordance with a coefficient (Kh) of the change in the rolling position of said one mill stand with respect to a change in said first dimension of said rolling material; and compensation means generating a compensation signal correcting said first rolling position control signal in accordance with a coefficient (Kbi) of the change in the rolling position of said one mill stand with respect to a change in said second dimension of said rolling material and also in accordance with a coefficient (Kbi−1) of the change in the rolling position of said other mill stand with respect to a change in said second dimension of said rolling material.

2. A control device as claimed on claim 1, wherein the rolling position of said one of said first and second mill stands is variable in the direction of said first dimension.

3. A control device as claimed in claim 2, further comprising second detection means detecting said second dimension of said rolling material corresponding substantially to the variable direction of said other of said first and second mill stands and generating a second detection signal, said control signal means generating said first rolling position control signal in accordance with said first detection signal and generating said second rolling position control signal in accordance with both said first and second detection signals.

4. A control device as claimed in claim 3, wherein said control signal means comprises:

third means comparing said second detection signal to a second reference signal to obtain a second difference signal, and fourth means responsive to said second difference signal and generating a further control signal in accordance with said coefficient Kbi−1, said second rolling position control signal comprising said further control signal and said compensation signal.

5. A control device as claimed in any one of claims 1, 2, 3 and 4, wherein said first mill stand is downstream of said second mill stand.

* * * * *